US006834740B2

(12) United States Patent
Kurttila

(10) Patent No.: US 6,834,740 B2
(45) Date of Patent: Dec. 28, 2004

(54) VEHICLE ENTRANCE-DOOR SAFETY-SYSTEM

(75) Inventor: Milton W. Kurttila, Benton, AR (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 196 days.

(21) Appl. No.: 10/233,949

(22) Filed: Sep. 3, 2002

(65) Prior Publication Data

US 2004/0040773 A1 Mar. 4, 2004

(51) Int. Cl.[7] ..... E05F 15/02
(52) U.S. Cl. ..... 180/286; 49/27; 200/61.43
(58) Field of Search ..... 180/286, 289; 701/45; 200/61.43; 49/26, 27, 28; 307/112, 116, 119

(56) References Cited

U.S. PATENT DOCUMENTS 3,710,050 A * 1/1973 Richards ..... 200/61.43
3,919,809 A * 11/1975 Haughton ..... 49/368
4,051,336 A * 9/1977 Miller ..... 200/61.43
4,133,365 A * 1/1979 Schleicher ..... 160/118
5,100,336 A 3/1992 Burgess et al.
5,167,522 A 12/1992 Behning
5,222,168 A 6/1993 Saito et al.
5,316,347 A 5/1994 Arosio
5,328,388 A 7/1994 Fust et al.
5,342,098 A 8/1994 Wilkins
5,507,530 A 4/1996 Mahaney
5,600,747 A 2/1997 Yamakawa et al.
5,675,681 A 10/1997 Chiaretti et al.
5,728,984 A 3/1998 Miller
5,962,825 A 10/1999 Miller
6,046,510 A * 4/2000 Kawanobe et al. ..... 307/10.1

* cited by examiner

*Primary Examiner*—David R. Dunn
(74) *Attorney, Agent, or Firm*—Jeffrey P. Calfa; Dennis Kelly Sullivan; Susan L. Lukasik

(57) ABSTRACT

An entrance-door safety-system for a vehicle that includes a contact-sensing door-edge attachment that is adapted to be mounted to a door edge of a door panel of the vehicle. The entrance-door safety-system also includes a door-safety-logic system that is constructed in such a manner and that is adapted to be communicatively linked to the contact-sensing door-edge attachment, an entrance-door control-system of the vehicle, and a powered actuator of the vehicle in such a manner that when the contact-sensing door-edge attachment contacts an obstruction, the door-safety-logic system causes the powered actuator to cease actuating the door panel toward its closed position. The contact-sensing door-edge attachment has a unique shape that provides a particularly effective weather barrier and that has a high tolerance to positional variance relative to other components of the vehicle.

42 Claims, 7 Drawing Sheets

VEHICLE ENTRANCE-DOOR SAFETY-SYSTEM

BACKGROUND OF THE INVENTION

The present invention relates to entrance-door safety systems that cause power actuated closing of a door panel to cease when a contact-sensing door-edge attachment mounted to a door edge of the door panel contacts an object or individual disposed within an entrance-door opening.

DRAWINGS

Other objects and advantages of the invention will become more apparent upon perusal of the detailed description thereof and upon inspection of the drawings in which.

DETAILS OF INVENTION

Figure 1:
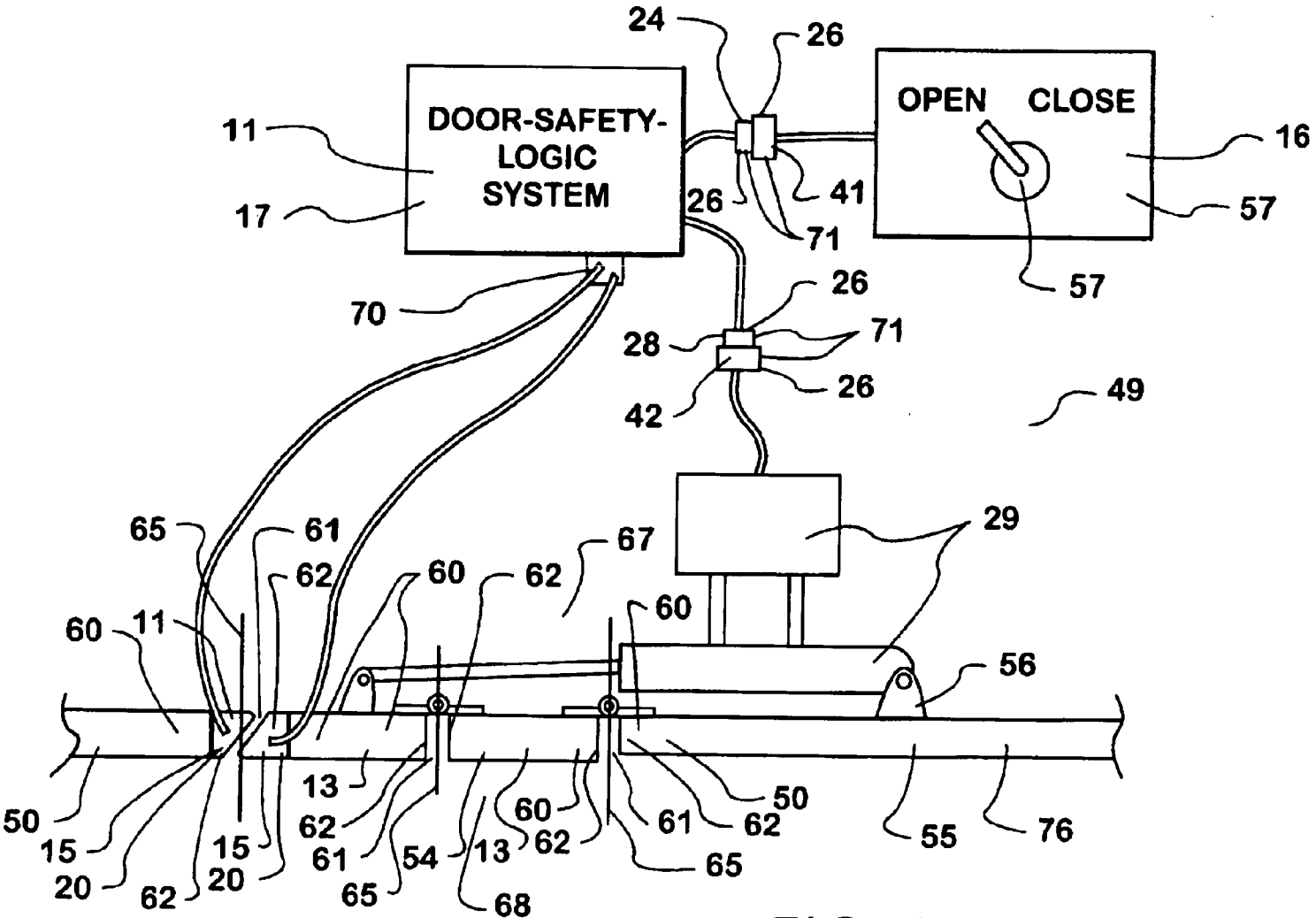
FIG. 1 shows an entrance-door system according to the present invention with some components thereof represented schematically.

Referring now to FIGS. 1–7 there are shown various embodiments of the present invention. The present invention includes a novel entrance-door safety-system 11 for the entrance-door system 49 of a vehicle 12. The present invention also includes vehicles 12 that comprise entrance-door safety-systems 11 in accordance with the present invention. As can best be seen in FIGS. 1 and 6, an entrance-door system 49 of a vehicle 12 includes an entrance-door frame 50 that defines an entrance-door opening 54 through which objects and individuals may pass between an interior side 67 and an exterior side 68 of the entrance-door opening 54. An entrance-door system 49 of a vehicle 12 also includes one or more door panels 13 that are mounted adjacent the entrance-door frame 50 in such a manner that they are moveable through translation and/or pivoting between a closed position in which the door panels 13 extend across and prevent passage through the entrance-door opening 54 and an open position in which the door panels 13 leave the entrance-door opening 54 unobstructed so that objects and/or individuals may pass through it. Entrance-door systems 49 in accordance with the present invention further comprise a powered actuator 29 such as an electric, hydraulic, or pneumatic rotary or linear motor that is engaged to the door panels 13 and also actuator-mounting structure 56 of the vehicle 12 in such a manner that when the powered actuator 29 is activated it actuates the door panels 13 toward either their closed or their open position. A vehicle 12 in accordance with the present invention further comprises an entrance-door control-system 16 that comprises entrance-door controls 57 and which is communicatively linked to said powered actuator 29 such that an operator of the vehicle 12 can manipulate the entrance-door controls 57 to selectively cause the powered actuator 29 to actuate the door panel(s) 29 toward their closed or their open position.

During the operation of an entrance-door system 49 and entrance-door control-system 16 thereof as described above, door edge(s) 60 of the door panels 13 or components mounted to them will contact objects and/or individuals that are disposed within the entrance-door opening 54 when an operator of the vehicle 12 operates the entrance-door control-system 16 to cause the powered actuator 29 to actuate the door panels 13 toward their closed position. The entrance-door safety-system 11 of the present invention includes at least one contact-sensing door-edge attachment 15 mounted to a door edge 60 of a door panel 13 of the entrance-door system 49. The entrance-door safety-system 11 of the present invention is constructed and interacted with the entrance-door system 49 and the entrance-door control-system 16 in such a manner that, when the powered actuator 29 is actuating the door panels 13 toward their closed position and a contact-sensing door-edge attachment 15 that is mounted to the door edge 60 of a door panel 13 contacts an object or individual disposed in the entrance-door opening 54, the powered actuator 29 is caused to cease actuation of the door panels 13 toward their closed position. In order to effect such a functionality, each of the contact-sensing door-edge attachments 15 of the entrance-door safety-system 11 is constructed and communicatively linked to a door-safety-logic system 17 of the entrance-door safety-system 11 in such a manner that, when the contact-sensing door-edge attachment 15 contacts an object it sends a "contact-sensed" signal to the door-safety-logic system 17. Dependent upon what medium the contact-sensing door-edge attachment 15 communicates with the door-safety-logic system 17 through, a "contact-sensed" signal could be embodied in a change in any of a number of different parameters including but not limited to electrical current flow, electrical voltage, fluid pressure, and light transmission. The door-safety-logic system 17 is, in turn, constructed and communicatively linked to the entrance-door control-system 16 and/or the powered actuator 29 in such a manner that, when a "contact-sensed" signal is received from a contact-sensing door-edge attachment 15 and the powered actuator 29 is actuating the door panels 13 toward their closed position, the door-safety-logic system 17 sends signals to the entrance-door control-system 16 and/or the powered actuator 29 that cause the powered actuator 29 to cease actuating the door panels 13 toward their closed position. In some embodiments of the present invention the door-safety-logic system 17 is an integral part of the entrance-door control-system 16 and in other embodiments the door-safety-logic system 17 and the entrance-door control-system 16 will have been created separately from one another and subsequently communicatively linked to one another. There are many well-known variations of entrance-door safety-systems 11 and it is anticipated that there will be many future-conceived variations of entrance-door safety-systems 11 that are constructed as described above and to which a person of ordinary skill in the art could readily adapt the novel features of the present invention and, thus, construct an entrance-door safety-system 11 in accordance with the present invention.

When the door panels 13 of an entrance-door system 49 are in their closed position, portions of adjacent components of the entrance-door system 49 meet at entrance-door interfaces 61. As can be seen in FIG. 1, which depicts an entrance-door system 49 with the door panels 13 thereof in their closed positions, entrance-door interfaces 61 exist between adjacent door panels 13 and between door panels 13 and the entrance-door frame 50. The components of an entrance-door system 49 comprise door-interface structures 62 each of which is disposed adjacent an entrance-door interface 61 when the door panels 13 of the entrance-door system 49 are in their closed position. Door-interface structures 62 that are complimentary to one another are the door-interface structures 62 that are disposed upon opposite sides of a particular entrance-door interface 61 when the door panels 13 of tile entrance-door system 49 are closed. The door-interface structures 62 of an entrance-door system 49 can include door edges 60 of the entrance-door system 49 and also structures, such as contact-sensing door-edge attachments 15, mounted to door edges 60 of the entrance-door system 49. It should be pointed out that, for purpose of this disclosure, a door edge 60 of an entrance-door system 49 is considered to be the portion of a door panel 13 or the entrance-door frame 50 that is nearest to an entrance-door interface 61.

Figure 2:
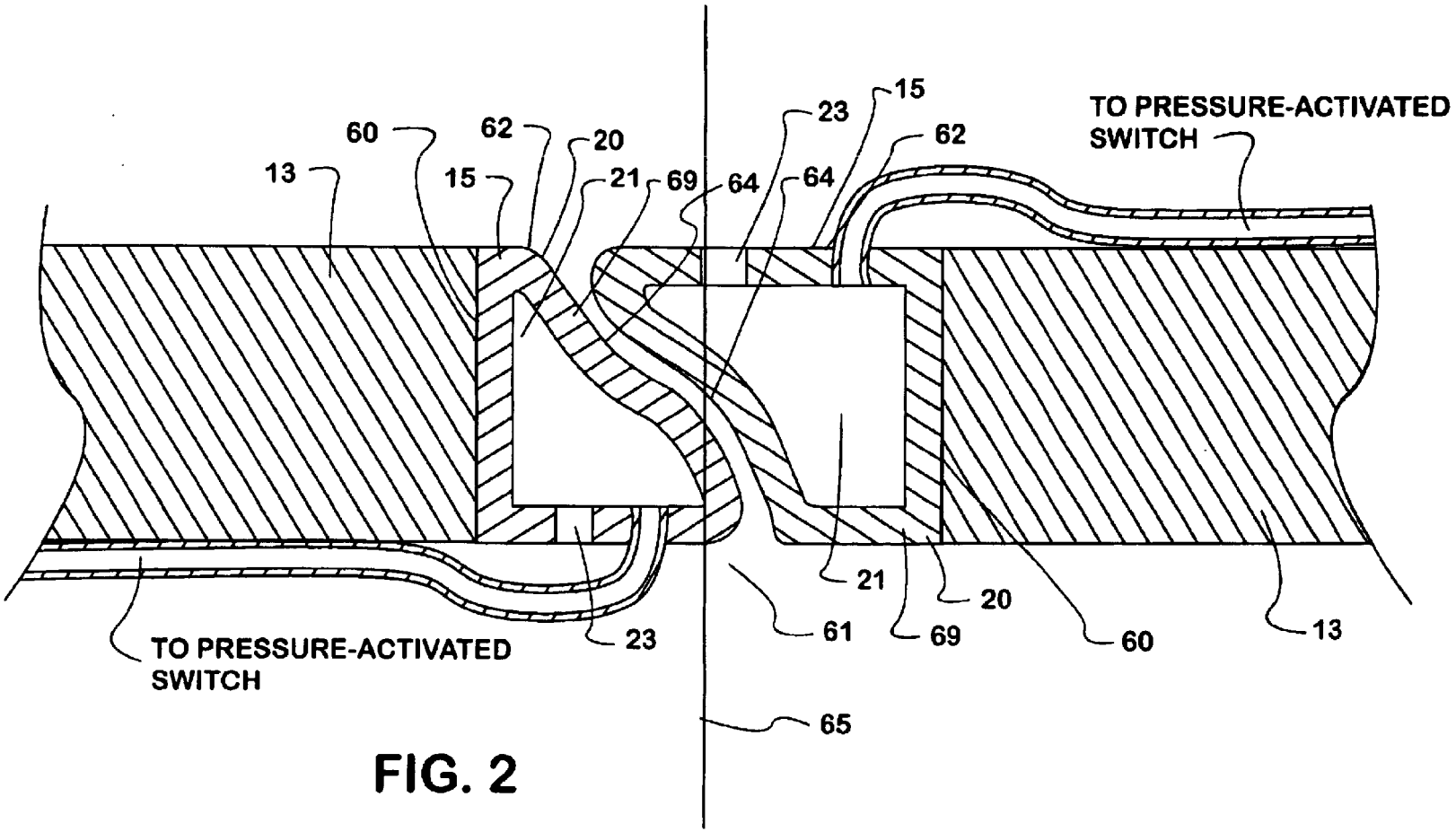
FIG. 2 shows an entrance-door interface between two door panels with first and second embodiments of contact-sensing door-edge attachments according to the present invention mounted to the door edges of the door panels.
Figure 3:
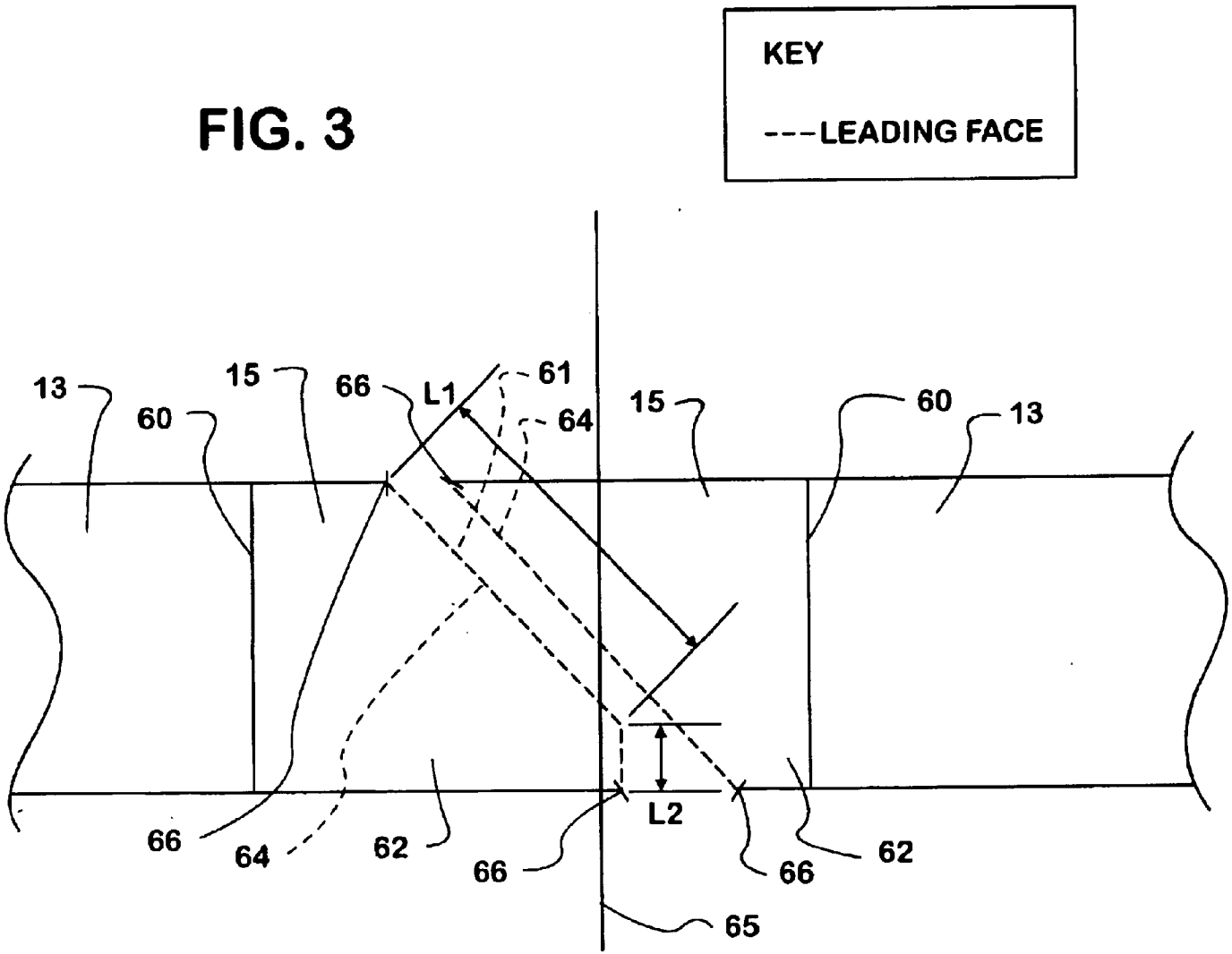
FIG. 3 shows third and fourth embodiments of contact-sensing door-edge attachments according to the present invention mounted to the door edges of door panels and with the leading faces thereof highlighted as a result of being drawn with a unique line style.
Figure 4:
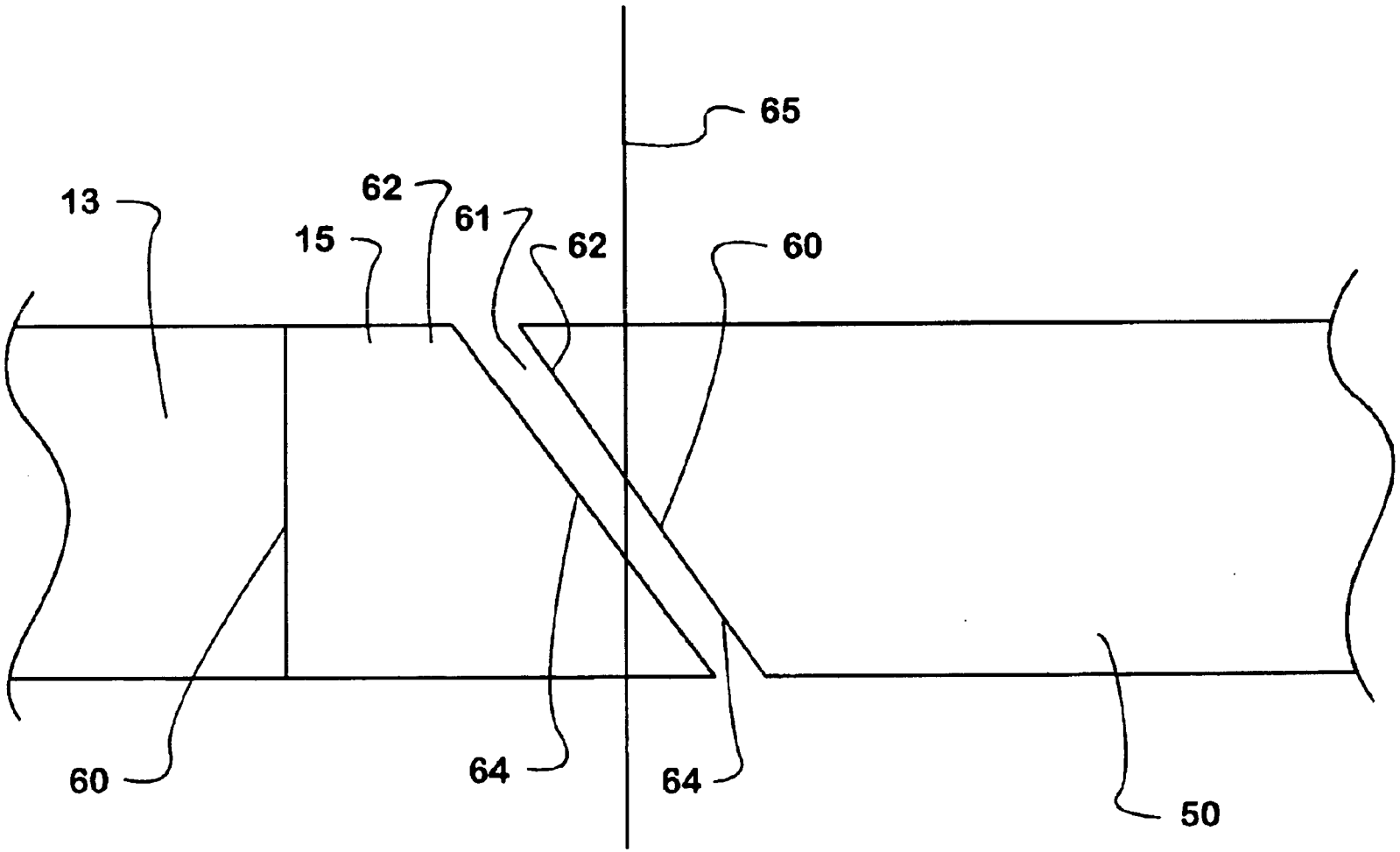
FIG. 4 shows a fifth embodiment of a contact-sensing door-edge attachment according to the present invention attached to a door panel and disposed upon an opposite side of an entrance-door interface from a door-interface structure that is of a type other than a contact-sensing door-edge attachment and that has a shape in accordance with the present invention.

The door-interface structures 62 that are disposed upon opposite sides of a given entrance-door interface 61 may be of the same type or they may be of different types. FIG. 4 shows an embodiment of the present invention in which a contact-sensing door-edge attachment 15 and a door edge 60 of the entrance-door frame 50 constitute complimentary door-interface structures 62 disposed upon opposite sides of an entrance-door interface 61. FIGS. 1, 2, 3, and 6 show embodiments of the present invention in which contact-sensing door-edge attachments 15 constitute complimentary door-interface structures 62 disposed upon opposite sides of an entrance-door interface 61.

One novel aspect of some embodiments of the present invention is the shape and orientation relative to other components of the entrance-door system 11 of the leading face 64 of one or more of the door-interface structures 62. The leading face 64 of a door-interface structure 62 is a portion of the outer surface of the door-interface structure 62 that is disposed adjacent the entrance-door interface 61, when the door panels 13 of the entrance-door system are in their closed positions. For purposes of this disclosure, the leading face 64 of a door-interface structure 62 is considered to have finite bounds. For purposes of this disclosure the leading face 64 of a door-interface structure 62 is considered to include those portions and only those portions of the outer surface of the interface structure 62 that project perpendicularly onto an interface-bisection plane 65 when the door panels 13 are in their closed position. This is best shown in FIG. 3, which illustrates an entrance-door interface 61, its interface-bisection planes 65, and the door-interface structures 62 adjacent thereto with the leading faces 64 of those door-interface structures 62 distinguished from other portions thereof through the use of different line styles and the leading faces 64 additionally demarcated by leading-face boundary lines 66. The interface-bisection plane 65 of an entrance-door interface 61 between two door panels 13 is a plane that is disposed at the same angle relative to each of the door panels 13 on opposite sides of the entrance-door interface 61. The interface-bisection 65 plane of an entrance-door interface 61 between a door panel 13 and the entrance-door frame 50 is a plane that is perpendicularly oriented to the plane of the door panel 13 that is adjacent that entrance-door interface 61.

In some embodiments of the present invention the shape and orientation of the leading face 64 of one or more of the door-interface structures 62 enables the door-interface structure 62 to function as a particularly effective weather barrier when the door panels 13 are in their closed position and to also have considerable tolerance for variance in relative positioning of the door-interface structure 62 to which it is complementary. In some embodiments of the present invention one or more of the door-interface structures 62 is constructed and oriented relative to the other components of the entrance-door system 49 such that, when the door panels 13 are in their closed positions, within transverse cross-sections (perpendicular to the longitudinal axis of the door-interface structure 62) of the door-interface structure 62, at least three quarters of the leading face 64 is slopes in a same general direction at an angle of between twenty and seventy degrees relative to the interface-bisection plane 65 of the entrance-door interface 61 adjacent the door-interface structure 62. It should be noted that, by stating that one portion of the leading face 64 slopes in the same general direction as another it is meant that the two portions extend in the same direction from the entrance-door interface 61 as they extend away from the interior side 67 of the entrance-door opening 54. In some, such embodiments, such as the ones shown in FIGS. 4 and 7, the leading face 64 of such a door-interface structure 62 is disposed at the same angle relative to the interface-bisection plane 65 along substantially its entire extent. In other embodiments of the present invention, such as the one shown in FIG. 2, the angle of the leading face 64 of the door-interface structure 62 varies along its extent, but stays between twenty and seventy degrees relative to the interface-bisection plane 65. In some embodiments of the present invention one or more of the door-interface structures 62 that has at least three quarters of its leading face 64 that slopes in a same general direction at an angle of between twenty and seventy degrees relative to the interface-bisection plane 65 is a contact-sensing door-edge attachment 15. A door-interface structure 62 that has three quarters or more of its leading face sloping in a same general direction at an angle of between 20 and 70 degrees relative to the interface-bisection plane 65 is more tolerant to variation in positioning relative to its complimentary door-interface structure 62 because a given amount of misalignment of the complimentary door-interface structure 62 in directions parallel or perpendicular to the interface-bisection plane 65 results in considerably less misalignment between the complimentary door-interface structures in directions perpendicular to the leading faces 64 thereof. A door-interface structure 62 that has at least three quarters of its leading face 64 sloping in a same general direction at an angle of between 20 and 70 degrees relative to the interface-bisection plane 65 also presents a particularly effective weather barricade because air and moisture has a relative long, torturous path to travel past the leading face 64 of the door-interface structure 62 if it is going to pass through the adjacent entrance-door interface 61. It should be mentioned that, for the purposes of this disclosure, the fraction of the leading face 64 of a transverse cross-section of a door-interface structure 62 that is considered to have a given angle is equal to the length of that portion compared to the entire length of the leading face 64 through the transverse cross-section of the door-interface structure 62. A door-interface structure 62 that has three quarters or more of its leading face disposed at an angle of between 20 and 70 degrees relative to the interface-bisection plane 65 is more tolerant to variation in positioning relative to its complimentary door-interface structure 62 because a given amount of misalignment of the complimentary door-interface structure 62 in directions parallel or perpendicular to the interface-bisection plane 65 results in considerably less misalignment between the complimentary door-interface structures in directions perpendicular to the leading faces 64 thereof. For example, the door-interface structure 62 shown in FIG. 3 on the left side thereof, has a leading face 64 with one portion thereof disposed at an angle of 45 degrees relative to the interface-bisection plane 65 and another portion of the leading face 64 that is parallel to the interface-bisection plane 65. As can be seen in FIG. 3, the portion of the leading face 64 that is disposed at a 45 degree angle to the interface-bisection plane 65 has a length of L1 and the portion of the leading face 64 that is parallel to the interface-bisection plane 65 has a length of L2, resulting in a total length of the leading face 64 equal to the sum of L1 and L2. The resulting fraction of the leading face 64 of the door-interface structure 62 shown in FIG. 3 that has an angle of 45 degrees relative to the interface-bisection plane 65 is L1/(L1+L2).

In some embodiments of the present invention both complimentary door-interface structures 62 disposed upon opposite sides of an entrance-door interface 61 have at least three quarters of their leading faces 64 sloping in a same general direction at an angle of between 20 and 70 degrees relative to the interface-bisection plane 65 of the entrance-door interface 61. Such embodiments of the present invention are illustrated in FIGS. 1, 2, 3, 4, 5, and 7. Such complimentary pairs of door-interface structures 62 provide for an even better weather barricade and are even more tolerant to variance in relative positioning than are complimentary pairs of door-interface structures 62 that include only one door-interface structure 62 that has a leading face 64 at least three quarters of which slopes in a same general direction at an angle of between 20 and 70 degrees relative to the interface-bisection plane 65. One or both door-interface structures 62 of a pair of complimentary door-interface structures 62 disposed upon opposite sides of an entrance-door interface 61 that have at least three quarters of their leading faces 64 sloping in a same general direction at an angle of between 20 and 70 degrees relative to the interface-bisection plane 65 of the entrance-door interface 61 may be contact-sensing door-edge attachments 15. FIG. 4 illustrates a pair of complimentary door-interface structures 62 disposed upon opposite sides of an entrance-door interface 61 that have at least three quarters of their leading faces 64 sloping in a same general direction at an angle of between 20 and 70 degrees relative to the interface-bisection plane 65 of the entrance-door interface 61 including one door-interface structure 62 that is a contact-sensing door-edge attachment 15 and one door-interface structure 62 that is a door edge 60. FIGS. 1, 2, and 3 illustrate a pair of complimentary door-interface structures 62 that are both contact-sensing door-edge attachments 15 that are disposed upon opposite sides of an entrance-door interface 61 that have at least three quarters of their leading faces 64 sloping in a same general direction at an angle of between 20 and 70 degrees relative to the interface-bisection plane 65 of the entrance-door interface 61.

As was mentioned above, there are many different types of contact-sensing door-edge attachments 15 that may be utilized in the present invention. Some types of contact-sensing door-edge attachments 15 have electrical switching components that are caused to change state (open or closed) when they contact an obstruction and are compressed. An example of a contact-sensing door-edge attachment that includes such electrical switching components is provided in U.S. Pat. No. 5,962,825 to Miller Edge, Inc. which patent is incorporated herein by reference. Of course it will be understood that innumerable other variations of contact-sensing door-edge attachments 15 that comprise electrical switching components that are compressed when the contact-sensing door-edge attachment 15 is compressed may be utilized in embodiments of the present invention. In embodiments of the entrance-door safety-system 11 of the present invention in which contact-sensing door-edge attachments 15 that comprise electrical switching components are utilized the electrical contacts of the electrical switching components of those contact-sensing door-edge attachments 15 are connected to the door-safety-logic system 17 of the entrance-door safety-system 11 and a change of state of the electrical switching components when the contact-sensing door-edge attachment 15 is compressed results in an electrical signal that may be interpreted as a "contact-sensed" signal is sent to the door-safety-logic system 17. Some types of contact-sensing door-edge attachments 15 are fluid-chamber contact-sensing 20 that have a fluid bladder 69 that extends along the longitudinal axis thereof and that defines within itself an internal fluid chamber 21. Embodiments of contact-sensing door-edge attachments that have such fluid-chamber contact-sensing door-edge attachments 20 are shown in FIGS. 1, 2, 3, 4, 5, and 7 and also disclosed in U.S. Pat. No. 5,728,984 to Miller Edge, Inc. which patent is incorporated herein by reference. In most embodiments of the present invention in which a fluid-chamber contact-sensing door-edge attachment 20 is utilized, the internal fluid chamber 21 thereof is placed in fluid communication, through means such as tubing, with a pressure activated switch 70 that changes state when it is subjected to a spike in fluid pressure. In such constructions of an entrance-door safety-system 11 according to the present invention, when the fluid-chamber 21 of a contact-sensing door-edge attachment 15 is compressed as a result of the fluid-chamber contact-sensing door-edge attachment contacting an object in the entrance-door opening 54, a spike in fluid pressure, which may be interpreted as a "contact-sensed" signal is transmitted to the pressure-activated switch 70 which thereupon changes state. In some embodiments of the present invention fluid-chamber contact-sensing door-edge attachments 20 have internal fluid chambers 21 that are totally sealed except for their communication with the pressure-activated switch 70 of the door-safety-logic system 17. In other embodiments of the present invention, such as those shown in FIGS. 2 and 7, a bleed hole 23 is present in the outer wall of the internal fluid chamber 21 of one or more fluid-chamber contact-sensing door-edge attachments 15. Such a bleed hole 23 in the outer wall of the internal fluid chamber 21 of a fluid-chamber contact-sensing door-edge attachment 15 allows the pressure inside the internal fluid chamber 21 to adjust to atmospheric pressure in order to ensure that a pressure spike which would be interpreted as a "contact-sensed" signal would only occur as a result of a compression of the internal fluid chamber 21 of the fluid-chamber contact-sensing door-edge attachment 20. Many different variations of the details of constructing and interacting contact-sensing door-edge attachments 15 with door-safety-logic system 17 in order to effect the general functionality of an entrance-door safety-system 11 as described above are generally well-known and well documented in publications such as the above-mentioned patents that have been incorporated by reference and will not, therefore be discussed at greater length within this disclosure.

The entrance-door control-system 16 and the door-safety-logic system 17 of an entrance-door system 49 according to the present invention may produce signals that exist in one or more of a number of different mediums. In any given embodiments of an entrance-door systems 49 and entrance-door safety-system 11 according to the present invention the entrance-door control-system 16, the door-safety-logic system 17 and components of these systems may be configured to communicate through the transmission of electrical, pneumatic, hydraulic, and/or optical signals. In those embodiments of the present invention in which the entrance-door control-system 16, door-safety-logic system 17, and/or components thereof are configured to communicate with one another through electrical or optical signals the logical operations of the entrance-door control-system 16 and the door-safety-logic system 17 may be executed by discrete components such as resistors, switches and transistors, by microcomputer components executing software programs, or by some combination thereof.

Figure 5:
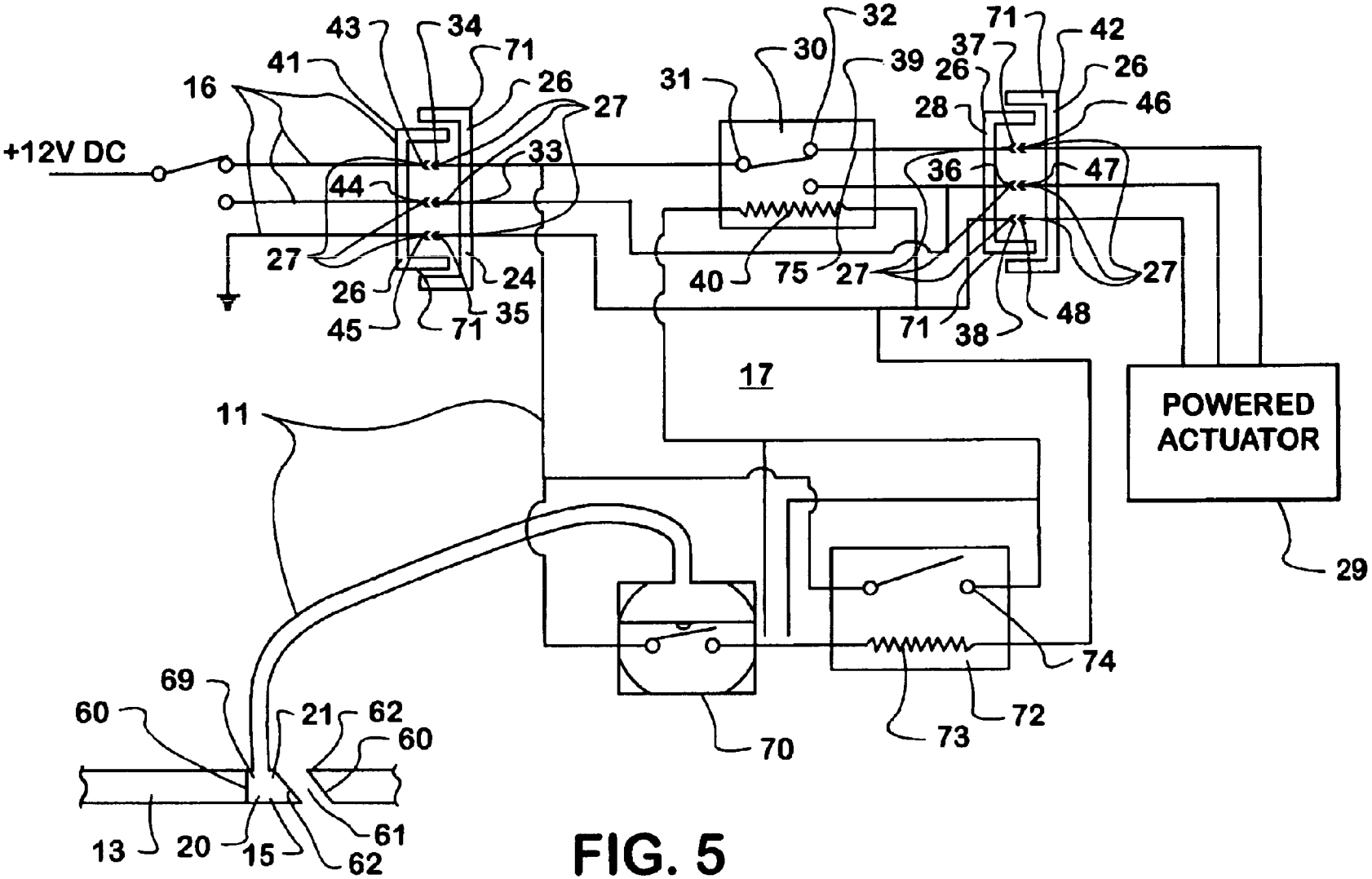
FIG. 5 is a schematic representation of one embodiment of an entrance-door control-system, a door-safety-logic system, and a powered actuator constructed and communicatively linked to one another in accordance with the present invention.
Figure 6:
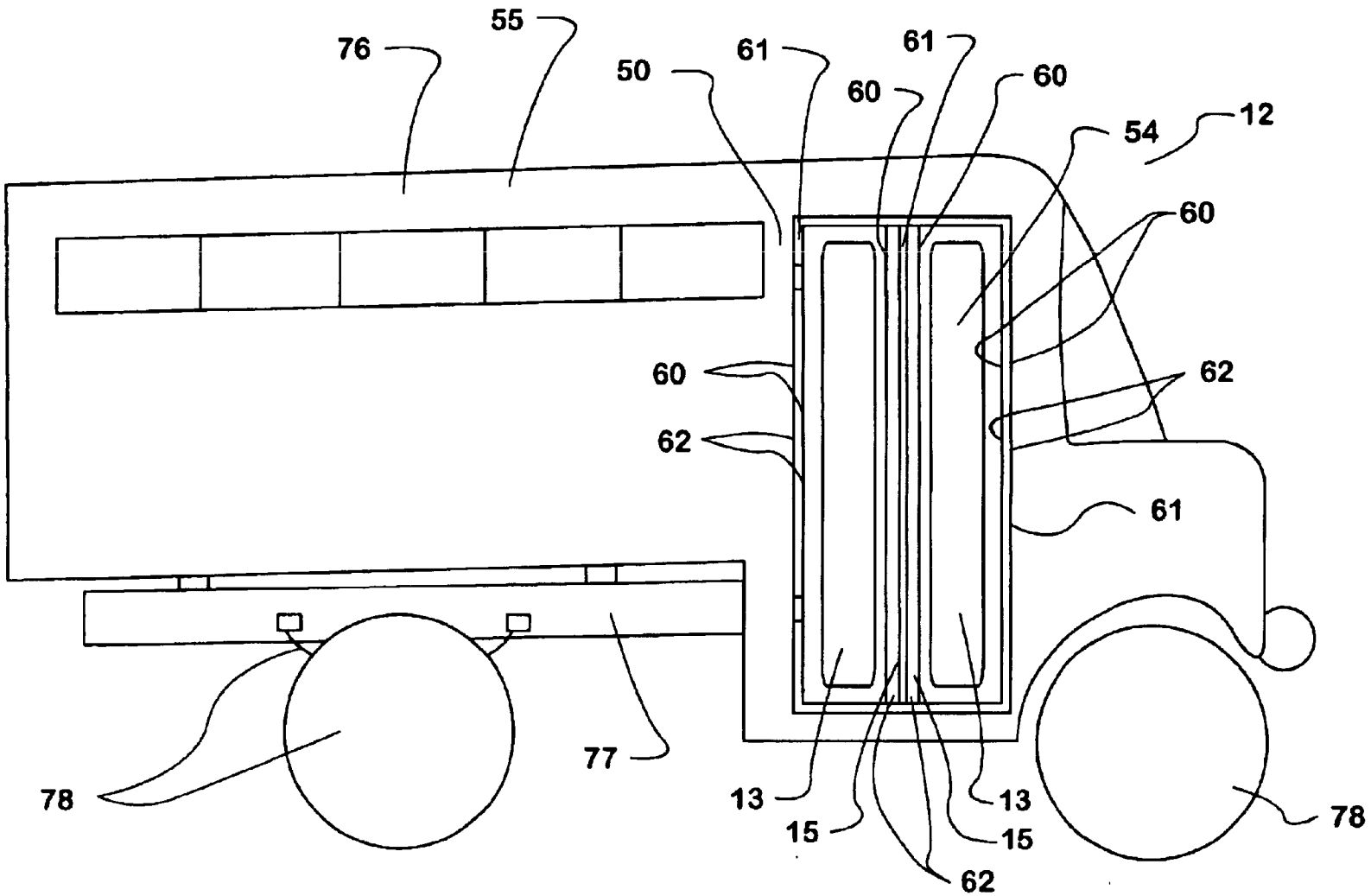
FIG. 6 shows one embodiment of a vehicle and an entrance-door system thereof in accordance with the present invention.
Figure 7:
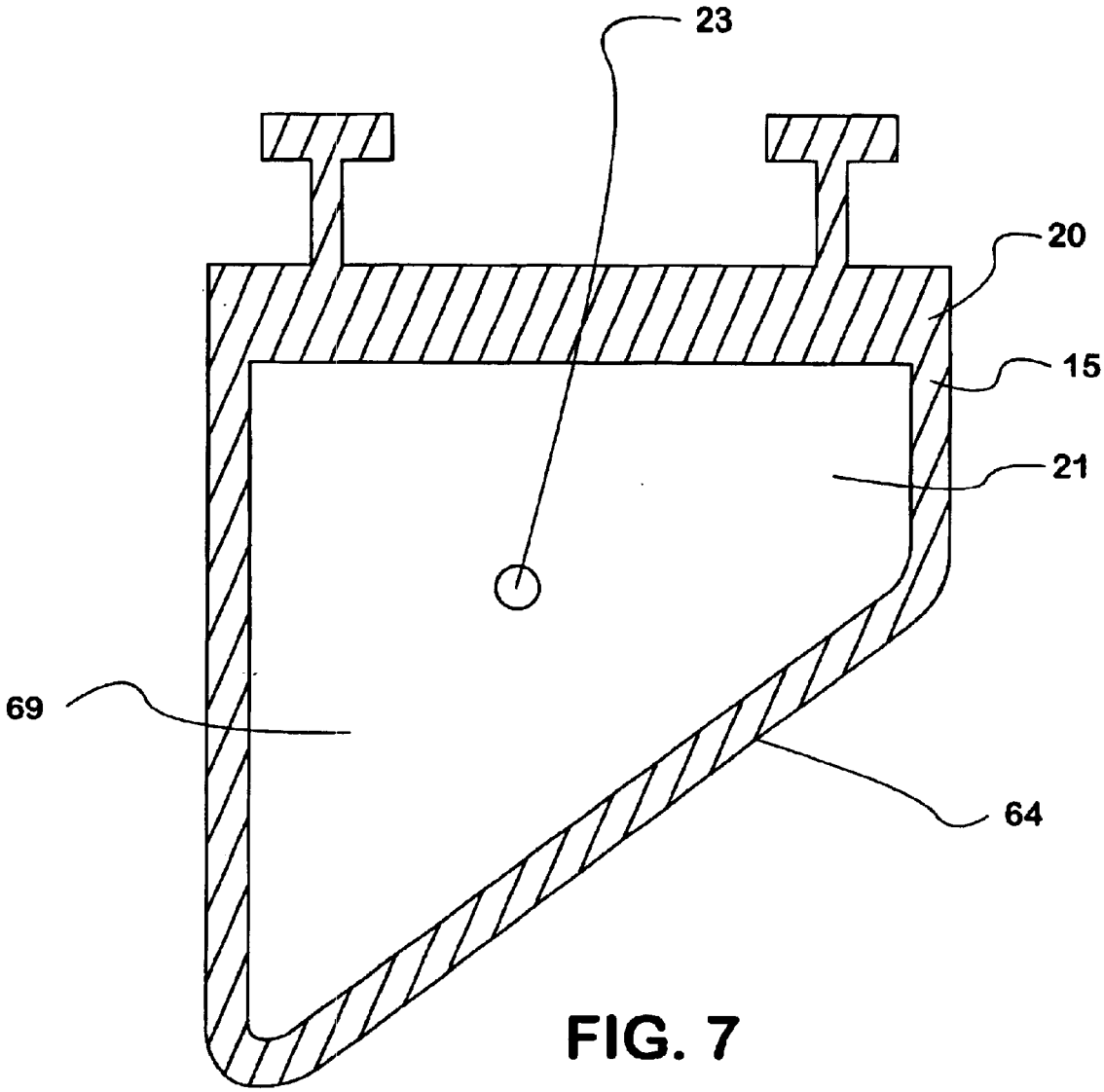
FIG. 7 shows the transverse cross-section of a sixth embodiment of a contact-sensing door-edge attachment according to the present invention.

As was mentioned above, an entrance-door system 49 according to the present invention includes an entrance-door control-system 16 that is communicatively linked to and controls the operation of the powered actuator 29 of the entrance-door system 49. Additionally, as was mentioned above, the door-safety-logic system 17 of an entrance-door system 49 according to the present invention is communicatively linked to the entrance-door control-system 16 and/or the powered actuator 29 in such a manner that, when one of the contact-sensing door-edge attachments 15 of the entrance-door safety-system 11 contacts an obstruction in the entrance-door opening 54, the door-safety-logic system 17 can send signals to the entrance-door control-system 16 and/or the powered actuator 29 that cause the powered actuator to cease actuating the door panel(s) 13 toward their closed position. The entrance-door control-system 16, the door-safety-logic system 17 and the powered actuator 29 of an entrance-door system 49 according to the present invention may be communicatively linked to one another in any of innumerable different ways. In some embodiments of the present invention, such as the one schematically illustrated in FIG. 5, the entrance-door control-system 16 is communicatively linked to the powered actuator 29 entirely through the door-safety-logic system 17, such that all control signals that are transmitted from the entrance-door control-system 16 to the powered actuator 29 are transmitted through the door-safety-logic system 17. In some embodiments of the present invention, such as the one illustrated schematically in FIG. 5, some of the communicative linkages between the entrance-door control-system 16, the door-safety-logic system 17 and/or the powered actuator 29 are effected through multi-terminal connector components 71. A multi-terminal connector component 71 being a component that comprises a connector body 26 to which multiple connection terminals 27 are mounted in an array for simultaneous connection to multiple connection terminals 27 of a complimentary connector component. Many different types of multi-terminal connector components 71 for connecting electrical, optical, pneumatic, and/or hydraulic circuits are well-known. Examples of multi-terminal connector components for connecting electrical circuits are shown in U.S. Pat. Nos. 5,328,388, 5,100,336, and 5,167,522 which patents are incorporated herein by reference. Examples of multi-terminal connector components 71 for connecting optical circuits are shown in U.S. Pat. Nos. 5,600,747, 5,222,168, and 5,675,681 which patents are incorporated herein by reference. Examples of multi-terminal connector components for connecting pneumatic or hydraulic circuits are shown in U.S. Pat. Nos. 5,316,347, 5,342,098, and 5,507,530 which patents are incorporated herein by reference. Communicatively linking the entrance-door control-system 16, the door-logic-safety system 17 and/or the powered actuator 29 to one another by using multi-terminal connector components 71 provides for easy, quick, and error-free connection to and disconnection from one another of these components/systems.

in some embodiments of the present invention, such as the one schematically illustrated in FIG. 5, the door-safety-logic system 17 is communicatively linked to the entrance-door control-system 16 entirely through a complimentary pair of multi-terminal connector components 71. In such embodiments, the door-safety-logic system 17 comprises a safety-system control-signal input connector 24 that is complimentary to and connected to a door-control-system control-signal output connector 41. In some embodiments of the present invention, such as the one schematically illustrated in FIG. 5, the entrance-door control-system 16 communicates with the door-safety-logic system 17 entirely through electrical signals, which consist of door-close signals and door-open signals, which may alternatively be sent to the door-safety-logic system 17. In some such embodiments of the present invention, including the one schematically represented in FIG. 5, the door-control-system control-signal output connector 41 comprises a door-close terminal 43 that is connected to a door-close terminal 34 of the safety-system control-signal input connector 24 and door-close signals are transmitted between these two respective terminals. In some such embodiments of the present invention, including the one schematically represented in FIG. 5, the door-control-system control-signal output connector 41 further comprises a door-open terminal 44 that is connected to a door-open terminal 33 of the safety-system control-signal input connector 24 and door-open signals are transmitted between these two respective terminals. In some such embodiments of the present invention, including the one schematically represented in FIG. 5, the door-control-system control-signal output connector 41 further comprises a common terminal 45 that is connected to a common terminal 35 of the safety-system control-signal input connector 24. In such embodiments either a positive voltage signal, such as 12 volts DC, or a ground voltage signal is communicated between the entrance-door control-system 16 and the door-safety-logic system 17 through the common terminal 45 of the door-control-system control-signal output connector 41 and the common terminal 35 of the safety-system control-signal input connector 24. Such a three-terminal connection and communication setup between an entrance-door control-system 16 and a door-safety-logic system 17 is cost effective and relatively easy to troubleshoot.

In some embodiments of the present invention, such as the one illustrated in FIG. 5, the door-control-system control-signal output connector 41 is constructed in such a manner that, in addition to the safety-system control-signal input connector 24, it can be connected to the actuator control-signal input connector 42 in such a manner that all communicative linking between the entrance-door control-system 16 and the powered actuator 29 is effected through the connection of the door-control-system control-signal output connector 41 to the actuator control-signal input connector. In the embodiment of the present invention shown in FIG. 5 such a connection of the door-control-system control-signal output connector 41 to the actuator control-signal input connector 42 would include connection of the door-open terminals 44, 47 thereof to one another, connection of the door-close terminals 43, 46 thereof to one another, and connection of the common terminals 45, 48 thereof to one another. Of course in other embodiments of the present invention the door-control-system control-signal output connector 41 and the actuator control-signal input connector 42 could very well have different numbers and types of connectors from the ones of the embodiment shown in FIG. 5 that must be connected to one another in order to effect full, direct, communicative linking of the entrance-door control-system 16 to the powered actuator 29. Such a construction of the door-control-system control-signal output connector 41, the safety-system control-signal input connector 24, the safety-system control-signal output connector 28, and the actuator control-signal input connector 42 enables operation of the entrance-door system 49 with the entrance-door control-system 16 directly communicatively linked to the powered actuator 29. Operation of the entrance-door system 49 in such a manner without the door-safety-logic system 17 can be beneficial when the door-safety-logic system 17 is inoperative and it is still desired to operate the vehicle 12 and, thus, the entrance-door system 49. Connecting the entrance-door control-system 16 directly to the powered actuator 29 can also be an effective troubleshooting aid when diagnosing malfunction of the entrance-door system 49 and construction of an entrance-door system 49 with a door-control-system control-signal output connector 41 and an actuator control-signal input connector 42 that can be directly connected enables expedited employment of this troubleshooting aid.

In some embodiments of the present invention, such as the one schematically illustrated in FIG. 5, the door-safety-logic system 17 is communicatively linked to the powered actuator 29 entirely through a complimentary pair of multi-terminal connector components 71. In such embodiments, the door-safety-logic system 17 comprises a safety-system control-signal output connector 28 that is complimentary to and connected to an actuator control-signal input connector 42. In some embodiments of the present invention, such as the one schematically illustrated in FIG. 5, the door-safety-logic system 17 communicates with the powered actuator 29 entirely through electrical signals, which consist of door-close signals and door-open signals, which may alternatively be sent to the powered actuator 29. In some such embodiments of the present invention, including the one schematically represented in FIG. 5, the safety-system control-signal output connector 28 comprises a door-close terminal 37 that is connected to a door-close terminal 46 of the actuator control-signal input connector 42 and door-close signals are transmitted between these two respective terminals. In some such embodiments of the present invention, including the one schematically represented in FIG. 5, the safety-system control-signal output connector 28 further comprises a door-open terminal 36 that is connected to a door-open terminal 47 of the actuator control-signal input connector 42 and door-open signals are transmitted between these two respective terminals. In some such embodiments of the present invention, including the one schematically represented in FIG. 5, the safety-system control-signal output connector 28 further comprises a common terminal 38 that is connected to a common terminal 48 of the actuator control-signal input connector 42. In such embodiments either a positive voltage signal, such as 12 volts DC, or a ground voltage signal is communicated between the door-safety-logic system 17 and the powered actuator 29 through the common terminal 38 of the safety-system control-signal output connector 28 and the common terminal 48 of the actuator control-signal input connector 42. Such a three-terminal connection and communication setup between an door-safety-logic system 17 and a powered actuator 29 is cost effective and relatively easy to troubleshoot.

As was mentioned above, a door-safety-logic system 17 according to the present invention may be constructed and interacted with an entrance-door control-system 16, a powered actuator 29, and one or more contact-sensing door-edge attachments 15 in any of a number of different ways as long as the door-safety-logic system 17 functions to cause the powered actuator 29 to cease actuating the door panel(s) 13 toward their closed position when one or more of the contact-sensing door-edge attachments 15 contact an obstruction. In the interest of ensuring that the reader is familiar with the details of construction and interaction of the door-safety-logic system 17, the entrance-door control-system 16, the powered actuator 29, and the contact-sensing door-edge attachments 15 of an entrance-door system 49, the details of construction and interaction of the components of FIG. 5 will be described herein below. The door-safety-logic system 17 illustrated schematically in FIG. 5 communicates with the powered actuator 29 and the entrance-door control-system 16 through electrical signals. Specifically, in this embodiment the entrance-door control-system 16, the door-safety-logic system 17, and the powered actuator 29 communicate door-close signals between one another by communicating positive voltage signals between the door-close terminals 34, 37, 43, and 46 of their respective control-signal connectors 24, 28, 41, and 42. The door-safety-logic system 17 shown in FIG. 5 includes a close-stop switch 30 with an input terminal 31 and a door-close output terminal 32. The close-stop switch 30 shown in FIG. 5 has an input terminal 30 that is connected to the door-close terminal 34 of the safety-system control-signal input connector 24 and the close-stop switch 30 has a door-close output terminal 32 that is connected to the door-close terminal 37 of the safety-system control-signal output connector 28. In the door-safety-logic system 17 illustrated in FIG. 5, the close-stop switch 30 is constructed and interacted with the rest of the components of the door-safety-logic system 17 in such a manner that, unless one of the contact-sensing door-edge attachments 15 contacts an obstruction and communicates a "contact-sensed" signal to the door-safety-logic system 17, the input terminal 31 and the door-close output terminal 32 of the close-stop switch 30 are connected to one another. Thus, unless one of the contact-sensing door-edge attachments 15 contacts an obstruction and communicates a "contact-sensed" signal to the door-safety-logic system 17, the door-close terminal 43 of the door-control-system control-signal output connector 41 is connected through the door-close terminal 34 of the safety-system control-signal input connector 24, the close-stop switch 30, and the door-close terminal 37 of the safety-system control-signal output connector 28 to the door-close terminal 46 of the actuator control-signal input connector 42. Thus, a complete path for transmission of door-close signals is defined between the entrance-door control-system 16 and the powered actuator 29 through the close-stop switch 30, unless and until one of the contact-sensing door-edge attachments 15 contacts an obstruction and communicates a "contact sensed" signal to the door-safety-logic system 17.

There are many ways that are well-known to and/or easily imaginable by a person of ordinary skill in the art in which a close-stop switch 30 could be incorporated into a door-close signal pathway of a door-safety-logic system 17 of an entrance-door safety-system 11 according to the present invention in order to effect functioning of the close-stop switch as described above. In the particular embodiment of present invention that is illustrated in FIG. 5 the close-stop switch 30 is a relay that connects its input terminal 31 to its door-close output terminal 32 when its energizing coil 40 is not energized and which disconnects its input terminal 31 from its door-close output terminal 32, when its energizing coil is energized. Furthermore, in the embodiment of the present invention that is illustrated in FIG. 5, the energizing coil 40 of the close-stop switch 30 is connected within circuitry of the door-safety-logic system 17 in such a manner that, when one of the contact-sensing door-edge attachments 15 contacts an obstruction and sends a "contact-sensed" signal to the door-safety-logic system 17, the energizing coil 40 of the close-stop switch 30 is energized and the pathway for the communication of a door-close signal from the entrance-door control-system 16 to the powered actuator 29 is broken. It will of course be understood that there are many ways that are well-known to and/or easily imaginable by a person of skill in the art that the circuitry of a door-safety-logic system 17 could be constructed and connected to the energizing coil 40 of a close-stop switch 30 of a door-safety-logic system 17 according to the present invention such that, when one or more of the contact-sensing door-edge attachments 15 contacts an obstruction and sends a "contact-sensed" signal to the door-safety-logic system 15 the energizing coil 40 is either energized or de-energized and the pathway for communication of a door-close signal from the entrance-door control-system 16 to the powered actuator 29 is broken. In the embodiment shown in FIG. 5 the energizing coil 40 of the close-stop switch 30 and a pressure-activated switch 70 that is fluidly communicated with one or more fluid-chamber contact-sensing door-edge attachments 20 are connected in series between the door-close terminal 34 of the safety-system control-signal input connector 24 and the common terminal 35 of the safety-system control-signal input connector 24. As a result, during operation of the door-safety-logic system 17 shown in FIG. 5, if a door-close signal is being communicated to the door-safety-logic system 17, the door-close signal is further communicated from the door-safety-logic system 17 to the powered actuator until one of the fluid-chamber contact-sensing door-edge attachments 15 contacts an obstruction and sends a "contact-sensed" signal (a pressure spike) to the pressure-activated switch 70 of the door-safety-logic system 17. However, when a door-close signal is sent to the door-safety-logic system 17 by the entrance-door control-system 16 and such a "contact-sensed" signal is received by the pressure-activated switch 70, the pressure-activated switch 70 (which is normally open) closes, the energizing coil of the close-stop switch 30 is energized, and the close-stop switch 30 disconnects its door-close output terminal 32 from its input terminal and ceases communication of the door-close signal to the powered actuator 29.

In the embodiment illustrated in FIG. 5 the door-safety-logic system 17 comprises a close-stop-maintenance switch 72 that is constructed and interacted with the other components of the door-safety-logic system 17 in such a manner that, once the close-stop switch 30 has been caused to disconnect its input terminal 31 from its door-close output terminal 32, the close-stop switch 30 is prevented from reconnecting its input terminal 31 to its door-close output terminal 32 unless and until communication of a door-close signal from the entrance-door control-system 16 ceases. In the embodiment illustrated in FIG. 5, the close-stop-maintenance switch 72 is a relay that has its energizing coil 73 connected in series with the pressure-activated switch 70 between the door-close terminal 34 of the safety-system control-signal input connector 24 and the common terminal 35 of the safety-system control-signal input connector 24. Thus, when a door-close signal is being communicated to the door-safety-logic system 17 and one or more of the fluid-chamber contact-sensing door-edge attachments 15 sends a "contact-sensed" signal to the pressure-activated switch 70 and causes the pressure activated switch 70 to assume a closed operational state, the energizing coil 73 of the close-stop-maintenance switch 72 is energized. In such circumstances, when the energizing coil 73 of the close-stop-maintenance switch 72, which is normally open relay, is energized, the close-stop-maintenance switch 72 connects the energizing coil 40 of the close-stop switch 30 to the door-close terminal 34 of the safety-system control-signal input connector 24 through a circuit that is parallel to the one through which the pressure-activated switch 70 directly connects the energizing coil 40 of the close-stop switch 30 to the door-close terminal 34 of the safety-system control-signal input connector 24. By virtue of its output terminal 74 also being connected to its energizing coil 73 the close-stop-maintenance switch 72 is self-latching and maintains its energizing coil 73 in an energized state as long as power is applied to its input terminal 75 as a result of a door-close signal being communicated to the door-safety-logic system 17. Thus, once, during the communication of a door-close signal to the door-safety-logic system 17, the pressure-activated switch 70 is closed and the energizing coil 73 of the close-stop-maintenance switch 72 is energized, the energizing coil 73 of the close-stop-maintenance switch 72 remains energized and maintains the energizing coil 40 of the close-stop switch 30 energized and the door-close output terminal 32 of the close-stop switch 30 disconnected from the input terminal 31 of the close-stop switch 30 unless and until the door-close signal ceases to be communicated to the door-safety-logic system 17. As a result, during operation of the embodiment shown in FIG. 5, if one of the fluid-chamber contact-sensing door-edge attachments 15 contacts an obstruction, the powered actuation of the door panels 13 toward their closed position is ceased and resumption of powered actuation of the door panels 13 toward their closed position is prevented unless and until an operator of the vehicle 12 manipulates the entrance-door controls 57 in such a manner that the entrance-door control system 16 no longer communicates a door-close signal to the door-safety-logic system 17, such as by manipulating the entrance-door controls 57 to command the powered actuator 29 to actuate the door panels 13 toward their open position. Of course, it will be understood that there are many ways that are well-known to and/or easily imaginable by a person of skill in the art to construct and interact with one another a door-safety-logic system 17, an entrance-door control-system 16, contact-sensing door-edge attachments 15, and a powered actuator 29 of an entrance-door system 49 according to the present invention, that upon one or more of the contact-sensing door-edge attachments 15 contacting an obstruction, powered actuation of the door panels 13 toward their closed position is interrupted unless and until an operator of the vehicle 12 subsequently manipulates the entrance-door controls 57 to command some action by the powered actuator 29 other than actuation of the door panels 13 toward their closed position.

The embodiment shown in FIG. 5, is further constructed such that when one of the contact-sensing door-edge attachments 15 contacts an obstruction, the powered actuator 29 is caused not only to cease actuation of the door panels 13 toward their closed position, but is caused to initiate actuation of the door panels 13 toward their open position. Of course there are many ways that are well-known to and/or easily imaginable by a person of skill in the art to construct and interact a door-safety-logic system 17, an entrance-door control-system, contact-sensing door-edge attachments 15, and a powered actuator 29 with one another according to the present invention such that, when one or more of the contact-sensing door-edge attachments 15 contacts an obstruction, the power actuator is not only caused to cease actuation of the door panels 13 toward their closed position, but is also caused to actuate the door panels 13 toward their open position. In the embodiment of the present invention shown in FIG. 5, the close-stop switch 30 has, in addition to its door-close output terminal 32, a door-open output terminal 75 that is connected to the door-open terminal 36 of the safety-system control-signal output connector 28. In this embodiment of the present invention the close-stop switch 30 is constructed in such a manner that, when its energizing coil 40 is energized, it connects its input terminal 31 to its door-open output terminal 75 and, thus, connects the door-close terminal 34 of the safety-system control-signal input connector 24 to the door-open terminal 36 of the safety-system control-signal output connector 28. In such a situation where the door-close terminal 34 of the safety-system control-signal input connector 24 is connected to the door-open connector 36 of the safety-system control-signal output connector 28, a positive voltage signal communicated to the door-close terminal 34 of the safety-system control-signal input connector 28, which is a door-close signal by virtue of having been communicated to the door-close terminal 34, is effectively converted to a door-open signal as a result of being transferred to the door-open terminal 36 of the safety-system control-signal output connector 28 and is thusly communicated to the powered actuator as a door-open signal. Accordingly, during operation of the embodiment shown in FIG. 5, when the energizing coil 40 of the close-stop switch 30 is energized as a result of one of the contact-sensing door-edge attachments 15 contacting an obstruction as is described in greater detail above, any door-close signal communicated to the door-safety-logic system 17 is effectively converted into a door open signal and communicated to the powered actuator 29 as such by the door-safety-logic system 17, causing the powered actuator 29 to actuate the door panels 13 toward their open position.

A vehicle 12 according to the present invention may be of many different constructions that are well-known to and/or easily imaginable by a person of skill in the art. A vehicle 12 according to the present invention obviously has one or more body structures 76 one or more of which define entrance-door frames 50 and have door panels 13 and powered actuators 29 of entrance-door systems 49 mounted to them. A vehicle 12 according to the present invention also generally comprises one or more frame structures 77 that are of relatively rigid and strong construction and to which a majority of the other components of the vehicle 12, including the one or more body structures 76 thereof, are directly or indirectly engaged and from which those components derive support directly or indirectly. A vehicle 12 according to the present invention generally also comprises a suspension system 78 to which the one or more frame structures 77 of the vehicle 12 are engaged and from which the one or more frame structures 77 of the vehicle 12 derive support above the ground. In addition to providing support for the one or more frame structures 77 and, thus the majority of components of the vehicle 12 the suspension system 78 of the vehicle 12 is constructed in such a manner to provide the vehicle 12 with a relatively low resistance to movement along the ground.

It will, of course, be understood that an entrance-door safety-system 11 and a vehicle 12 that comprises it could be of any of a number of different constructions within the guidelines set forth above and that some features of the invention could be employed without a corresponding use of other features.

We claim:

1. An entrance-door safety-system for a vehicle that comprises a door panel that comprises a first door edge and wherein said entrance-door system comprises a second door edge that is disposed upon an opposite side of an entrance-door interface and the interface-bisection plane thereof from the first door edge when the door panel is in its closed position which vehicle comprises a powered actuator that actuates said door panel to and between open and closed positions when commanded to do so by an entrance-door control-system of the vehicle, said entrance-door safety-system comprising:

(a) a first contact-sensing door-edge attachment that is adapted to be mounted to the first door edge that the door panel comprises;

(b) a door-safety-logic system that is adapted to be communicatively linked to said first contact-sensing door-edge attachment, the entrance-door control-system of the vehicle, and the powered actuator of the vehicle and that is constructed in such a manner that, when said powered actuator is actuating said door panel toward its closed position, if said first contact-sensing door-edge attachment meets an obstruction and communicates a "contact sensed" signal to said door-safety-logic system, said door-safety-logic system causes said powered actuator to cease actuation of said door panel toward its closed position; and (c) wherein said first contact-sensing door-edge attachment defines a first leading face at least three quarters of which through a transverse cross-section of said first contact-sensing door-edge attachment slopes in a same general direction at an angle of between 20 and 70 degrees relative to the interface-bisection plane of the entrance-door interface adjacent which the first door edge is disposed when the door panel is in its closed position.

2. The entrance-door safety-system of claim 1, further comprising:

(a) a second contact-sensing door-edge attachment that is adapted to be mounted to the second door edge of the vehicle;

(b) wherein said door-safety-logic system is further adapted to be communicatively linked to said second contact-sensing door-edge attachment, the entrance-door control-system of the vehicle, and the powered actuator of the vehicle and is constructed in such a manner that, when said powered actuator is actuating said door panel toward its closed position, if said second contact-sensing door-edge attachment meets an obstruction and communicates a "contact-sensed" signal to said door-safety-logic system, said door-safety-logic system causes said powered actuator to cease actuation of said door-panel toward its closed position; and (c) wherein said second contact-sensing door-edge attachment defines a second leading face at least three quarters of which through transverse cross-sections of said second contact-sensing door-edge attachment slopes in a same general direction as does said first leading face and at an angle of between 20 and 70 degrees relative to the interface-bisection plane of the entrance-door interface adjacent which said second contact-sensing door-edge attachment is disposed.

3. The entrance-door safety-system of claim 2, wherein:

(a) at least one of said first contact-sensing door-edge attachment and said second contact-sensing door-edge attachment is a fluid-chamber contact-sensing door-edge attachment that defines an internal fluid chamber; and (b) said door-safety logic-system comprises a pressure-activated switch that is adapted to be fluidly communicated with an internal fluid chamber of at least one of said at least one fluid-chamber contact-sensing door-edge attachments and that is constructed in such a manner that, when the powered actuator is actuating the door panel toward its closed position and a pressure impulse is communicated to said pressure-activated switch from said fluid chamber of said fluid-chamber contact-sensing door-edge attachment, said fluid-chamber contact-sensing door-edge attachment is considered to have communicated a "contact-sensed" signal to said pressure-activated switch and said pressure-activated switch at least momentarily changes operational state and thereby directly or indirectly causes the powered actuator to cease actuating the door panel toward its closed position.

4. The entrance-door safety-system of claim 3, wherein:

(a) each of said fluid-chamber contact-sensing door-edge attachments defines a bleed-hole through which said internal fluid chamber thereof is in fluid communication with the surrounding atmosphere.

5. The entrance-door safety-system of claim 4, wherein:

(a) said door-safety-logic system is adapted to be connected to the entrance-door control-system and the powered actuator of the vehicle in such a manner that any door-control signals that are communicated between the entrance-door control-system and the powered actuator are communicated through said door-safety-logic system.

6. The entrance-door safety-system of claim 5, wherein:

(a) said door-safety-logic system comprises a safety-system control-signal input connector that comprises a connector body with multiple connection terminals mounted to and fixed in an array by said connector body of said safety-system control-signal input connector; and (b) said multiple connection terminals mounted to said connector body of said safety-system control-signal input connector include all connection terminals necessary to communicatively link said door-safety-logic system to the entrance-door control-system.

7. The entrance-door safety-system of claim 6, wherein:

(a) said door-safety-logic system comprises a safety-system control-signal output connector that comprises a connector body with multiple connection terminals mounted to and fixed in an array by said connector body of said safety-system control-signal output connector; and (b) said multiple connection terminals mounted to said connector body of said safety-system control-signal output connector include all connection terminals necessary to communicatively link said door-safety-logic system to the powered actuator.

8. The entrance-door safety-system of claim 7, wherein:

(a) said door-safety-logic system is adapted to communicate with the entrance-door control system and the powered actuator entirely through electrical control signals.

9. The entrance-door safety-system of claim 8, wherein:

(a) said multiple connection terminals that are mounted to said connector body of said safety-system control-signal input connector comprise a door-open terminal, a door-close terminal, and a common terminal.

10. The entrance-door safety-system of claim 9, wherein:

(a) said multiple connection terminals that are mounted to said connector body said of safety-system control-signal output connector comprise a door-open terminal, a door-close terminal, and a common terminal.

11. The entrance-door safety-system of claim 10, wherein:

(a) said multiple connection terminals that are mounted to said connector body of said safety-system control-signal input connector consist of said door-open terminal, said door-close terminal, and said common terminal.

12. The entrance-door safety-system of claim 11, wherein:

(a) said multiple connection terminals that are mounted to said connector body of said safety-system control-signal output connector consist of said door-open terminal, said door-close terminal, and said common terminal.

13. The entrance-door safety-system of claim 12, wherein:

(a) said door-safety-logic system comprises a close-stop switch with an input terminal that is connected to said door-close terminal of said safety-system control-signal input connector;

(b) said close-stop switch has a door-close output terminal that is connected to said door-close terminal of said safety-system control-signal output connector;

(c) said close-stop switch and said door-safety-logic system are constructed and interacted with one another in such a manner that, subsequent to initiation of operation of said door-safety-logic system, unless and until said pressure-activated switch changes operational state as a result of one of said at least one fluid-chamber contact-sensing door-edge attachments contacting an obstruction and communicating a "contact-sensed" signal thereto, said close-stop switch has an operational state in which its input terminal and its door-close output terminal are connected to one another such that a door-close control signal can be communicated between said door-close terminal of said safety-system control-signal input connector and said door-close terminal of said safety-system control-signal output connector through said close-stop switch; and (d) said close-stop switch and said door-safety-logic system are constructed and engaged to one another in such a manner that, subsequent to initiation of operation of said door-safety-logic system, when said pressure-activated switch changes operational state as a result of one of said at least one fluid-chamber contact-sensing door-edge attachments contacting an obstruction and communicating a "contact sensed" signal thereto, said close-stop switch assumes an operational state in which its input terminal and its door-close output terminal are disconnected from one another such that a door-close control signal cannot be communicated between said door-close terminal of said safety-system control-signal input connector and said door-close terminal of said safety-system control-signal output connector through said close-stop switch.

14. The entrance-door safety-system of claim 13, wherein:

(a) said close-stop switch is a relay that connects its input terminal to its door-close output terminal when its energizing coil is not energized and which disconnects its input terminal from its output terminal when its energizing coil is energized; and (b) said energizing coil of said close-stop switch is connected with circuitry of said door-safety-logic system in such a manner that, when a door-close signal is transmitted to said door-close terminal of said safety-system control-signal input connector and either of said first contact-sensing door-edge attachment and said second contact-sensing door-edge attachment contacts an obstruction, communicates a "contact-sensed" signal to said pressure-activated switch, and causes said pressure-activated switch to change operational state said energizing coil of said door-close switch is energized.

15. The entrance-door safety system of claim 14, wherein:

(a) said close-stop switch has a door-open output terminal that is connected to said door-open terminal of said safety-system control-signal output connector; and (b) said close-stop switch is of a construction such that, when its energizing coil is energized, its input terminal and its door-close output terminal are connected to one another.

16. The entrance-door safety system of claim 15, wherein:

(a) said energizing coil of said close-stop switch is connected in series with said pressure-activated switch between said door-close terminal of said safety-system control-signal input connector and said common terminal of said safety-system control-signal input connector.

17. An entrance-door safety-system for a vehicle that comprises a door panel that comprises a first door edge and a second door edge that are disposed upon opposite sides of an entrance-door interface and the interface-bisection plane thereof when the door panel is in its closed position which vehicle comprises a powered actuator that actuates said door panel to and between open and closed positions when commanded to do so by an entrance-door control-system of the vehicle, said entrance-door safety-system comprising:

(a) a first contact-sensing door-edge attachment that is adapted to be mounted to the first door edge that the door panel comprises;

(b) a door-safety-logic system that is adapted to be communicatively linked to said first contact-sensing door-edge attachment, the entrance-door control-system of the vehicle, and the powered actuator of the vehicle and that is constructed in such a manner that, when said powered actuator is actuating said door panel toward its closed position, if said first contact-sensing door-edge attachment meets an obstruction and communicates a "contact sensed" signal to said door-safety-logic system, said door-safety-logic system causes said powered actuator to cease actuation of said door panel toward its closed position;

(c) wherein said door-safety-logic system comprises a safety-system control-signal input connector that comprises a connector body with multiple connection terminals mounted to and fixed in an array by said connector body of said safety-system control-signal input connector;

(d) wherein said multiple connection terminals mounted to said connector body of said safety-system control-signal input connector include all connection terminals necessary to communicatively link said door-safety-logic system to the entrance-door control-system;

(e) wherein said door-safety-logic system comprises a safety-system control-signal output connector that comprises a connector body with multiple connection terminals mounted to and fixed in an array by said connector body of said safety-system control-signal output connector; and (f) wherein said multiple connection terminals mounted to said connector body of said safety-system control-signal output connector include all connection terminals necessary to communicatively link said door-safety-logic system to the powered actuator.

18. The entrance-door safety-system of claim 17, wherein:

(a) said multiple connection terminals that are mounted to said connector body of said safety-system control-signal input connector comprise a door-open terminal, a door-close terminal, and a common terminal.

19. The entrance-door safety-system of claim 18, wherein:

(a) said multiple connection terminals that are mounted to said connector body said of safety-system control-signal output connector comprise a door-open terminal, a door-close terminal, and a common terminal.

20. The vehicle of claim 19, wherein:

(a) said first contact-sensing door-edge attachment defines a first leading face at least three quarters of which through a transverse cross-section of said first contact-sensing door-edge attachment slopes in a same general direction at an angle of between 20 and 70 degrees relative to the interface-bisection plane of the entrance-door interface adjacent which the first door edge is disposed when the door panel is in its closed position.

21. The vehicle of claim 20, further comprising:

(a) a second contact-sensing door-edge attachment that is adapted to be mounted to the second door edge of the vehicle;

(b) wherein said door-safety-logic system is further adapted to be communicatively linked to said second contact-sensing door-edge attachment, the entrance-door control-system of the vehicle, and the powered actuator of the vehicle and is constructed in such a manner that, when said powered actuator is actuating said door panel toward its closed position, if said second contact-sensing door-edge attachment meets an obstruction and communicates a "contact-sensed" signal to said door-safety-logic system, said door-safety-logic system causes said powered actuator to cease actuation of said door-panel toward its closed position; and (c) wherein said second contact-sensing door-edge attachment defines a second leading face at least three quarters of which through transverse cross-sections of said second contact-sensing door-edge attachment slopes in a same general direction as does said first leading face and at an angle of between 20 and 70 degrees relative to the interface-bisection plane of the entrance-door interface adjacent which said second contact-sensing door-edge attachment is disposed.

22. A vehicle, comprising:

(a) one or more frame structures that to which a majority of other components of said vehicle are engaged directly or indirectly and from which a majority of other components of said vehicle derive support directly or indirectly;

(b) a suspension system to which said one or more frame structures of said vehicle are engaged and from which said one or more frame structures derive support above said ground;

(c) one or more body structures that are mounted to said one or more frame structures;

(d) wherein one or more of said body structures comprises an entrance-door frame structure that surrounds an entrance-door opening;

(e) wherein one or more door panels are mounted to said body structure adjacent said entrance-door frame structure in such a manner that said one or more door panels are moveable through some combination of pivoting and/or translating between closed positions in which said door panels extend across and obstruct passage through said entrance-door opening and an open position in which said door panels leave said entrance-door opening unobstructed allowing passage of objects and/or individuals through said entrance-door opening;

(f) wherein one of said door panels comprises a first door edge that is disposed upon an opposite side of an entrance-door interface and an interface-bisection plane thereof from a second door edge when said door panel is disposed in its closed position;

(g) a powered actuator that is connected directly or indirectly to said door panel and also to actuator-mounting structure of said vehicle in such a manner that, when said powered actuator is commanded to do so it can actuate said door panel between said closed position and said open position thereof;

(h) an entrance-door control-system that is communicatively linked to said powered actuator in such a manner that said entrance-door control-system can be operated by an operator of said vehicle to command said powered actuator to actuate said door panel between said closed position and said open position thereof;

(i) an entrance-door safety-system;

(j) wherein said entrance-door safety-system comprises a first contact-sensing door-edge attachment that is mounted to said first door edge that said door panel comprises;

(k) wherein said entrance-door safety-system comprises a door-safety-logic system that is communicatively linked to said first contact-sensing door-edge attachment, said entrance-door control-system of said vehicle, and said powered actuator of said vehicle and that is constructed in such a manner that, when said powered actuator is actuating said door panel toward its closed position, if said first contact-sensing door-edge attachment meets an obstruction and communicates a "contact sensed" signal to said door-safety-logic system, said door-safety-logic system causes said powered actuator to cease actuation of said door panel toward its closed position; and (l) wherein said first contact-sensing door-edge attachment defines a first leading face at least three quarters of which through a transverse cross-section of said first contact-sensing door-edge attachment slopes in a same general direction at an angle of between 20 and 70 degrees relative to said interface-bisection plane of said entrance-door interface adjacent which said first door edge is disposed when said door panel is in its closed position.

23. The vehicle of claim 22, wherein:

(a) said vehicle comprises a door-interface structure that is complimentary to and that is disposed upon an opposite side of said entrance-door interface from said first contact-sensing door-edge attachment; and (b) said door-interface structure defines a second leading face at least three quarters of which through a transverse cross-section of said door-interface structure slopes in a same direction as said first leading face at an angle of between 20 and 70 degrees relative to said interface-bisection plane.

24. The vehicle of claim 23, wherein:

(a) said door-interface structure that defines said second leading face is a second contact-sensing door-edge attachment that is mounted to a second door edge; and (b) said second contact-sensing door-edge attachment, said door-safety-logic system, said entrance-door control system, and said powered actuator are constructed and interacted with one another in such a manner that, when said powered actuator is actuating said door panel toward its closed position and said second contact-sensing door-edge attachment meets an obstruction and communicates a "contact-sensed" signal to said door-safety-logic system, said powered actuator is caused to cease actuating said door panel toward its closed position.

25. The vehicle of claim 24, wherein:

(a) at least one of said first contact-sensing door-edge attachment and said second contact-sensing door-edge attachment is a fluid-chamber contact-sensing door-edge attachment that defines an internal fluid chamber; and (b) said door-safety logic-system comprises a pressure-activated switch that is fluidly communicated with an internal fluid chamber of at least one of said at least one fluid-chamber contact-sensing door-edge attachments and that is constructed in such a manner that, when said powered actuator is actuating said door panel toward its closed position and a pressure impulse is communicated to said pressure-activated switch from said fluid chamber of said fluid-chamber contact-sensing door-edge attachment, said fluid-chamber contact-sensing door-edge attachment is considered to have communicated a "contact-sensed" signal to said pressure-activated switch and said pressure-activated switch at least momentarily changes operational state and thereby directly or indirectly causes said powered actuator to cease actuating said door panel toward its closed position.

26. The vehicle of claim 25, wherein:

(a) each of said fluid-chamber contact-sensing door-edge attachments defines a bleed-hole through which said internal fluid chamber thereof is in fluid communication with said surrounding atmosphere.

27. The vehicle of claim 26, wherein:

(a) said door-safety-logic system comprises a safety-system control-signal input connector that comprises a connector body with multiple connection terminals mounted to and fixed in an array by said connector body of said safety-system control-signal input connector;

(b) said entrance-door control-system comprises a door-control-system control-signal output connector that comprises a connector body with multiple connection terminals mounted to and fixed in an array by said connector body of said door-control-system control-signal output connector; and (c) all communicative linking of said entrance-door control-system to said door-safety-logic system is effected by connection of said connection terminals that are mounted to said connector body of said door-control-system control-signal output connector to said connection terminals that are mounted to said connector body of said safety-system control-signal input connector.

28. The vehicle of claim 27, wherein:

(a) said door-safety-logic system comprises a safety-system control-signal output connector that comprises a connector body with multiple connection terminals mounted to and fixed in an array by said connector body of said safety-system control-signal output connector;

(b) said powered actuator includes an actuator control-signal input connector that comprises a connector body with multiple connection terminals mounted to and fixed in an array by said connector body of said actuator control-signal input connector; and (c) all communicative linking of said door-safety-logic system to said powered actuator is effected by connection of said connection terminals that are mounted to said connector body of said safety-system control-signal output connector to said connection terminals that are mounted to said connector body of said actuator control-signal input connector.

29. The vehicle of claim 28, wherein:

(a) said door-control-system control-signal output connector and said actuator control-signal input connector are constructed in such a manner that they could be connected to one another in such a manner that all communicative linking between said door-control system and said powered actuator may be effected through connection of said connection terminals that are mounted to said connector body of said door-control-system control-signal output connector to said connection terminals that are mounted to said connector body of said actuator control-signal input connector.

30. The vehicle of claim 29, wherein:

(a) said multiple connection terminals that are mounted to said connector body of said safety-system control-signal input connector comprise a door-open terminal, a door-close terminal, and a common terminal;

(b) said multiple connection terminals that are mounted to said connector body of said door-control-system control-signal output connector comprise a door-open terminal, a door-close terminal, and a common terminal;

(c) said door-open terminal that is mounted to said connector body of said door-control-system control-signal output connector is connected to said door-open terminal that is mounted to said connector body of said safety-system control-signal input connector;

(d) said door-close terminal that is mounted to said connector body of said door-control-system control-signal output connector is connected to said door-close terminal that is mounted to said connector body of said safety-system control-signal input connector; and (e) said door-close terminal that is mounted to said connector body of said door-control-system control-signal output connector is connected to said door-close terminal that is mounted to said connector body of said safety-system control-signal input connector.

31. The vehicle of claim 30, wherein:

(a) said multiple connection terminals that are mounted to said connector body of said safety-system control-signal output connector comprise a door-open terminal, a door-close terminal, and a common terminal;

(b) said multiple connection terminals that are mounted to said connector body of said actuator control-signal input connector comprise a door-open terminal, a door-close terminal, and a common terminal;

(c) said door-open terminal that is mounted to said connector body of said safety-system control-signal output connector is connected to said door-open terminal that is mounted to said connector body of said actuator control-signal input connector;

(d) said door-close terminal that is mounted to said connector body of said safety-system control-signal output connector is connected to said door-close terminal that is mounted to said connector body of said actuator control-signal input connector; and (e) said common terminal that is mounted to said connector body of said safety-system control-signal output connector is connected to said common terminal that is mounted to said connector body of said actuator control-signal input connector.

32. The vehicle of claim 31, wherein:

(a) said multiple connection terminals that are mounted to said connector body of said safety-system control-signal input connector consist of said door-open terminal, said door-close terminal, and said common terminal; and (b) said multiple connection terminals that are mounted to said connector body of said door-control-system control-signal output connector consist of said door-open terminal, said door-close terminal, and said common terminal.

33. The vehicle of claim 32, wherein:

(a) said multiple connection terminals that are mounted to said connector body of said safety-system control-signal output connector consist of said door-open terminal, said door-close terminal, and said common terminal; and (b) said multiple connection terminals that are mounted to said connector body of said actuator control-signal input connector consist of said door-open terminal, said door-close terminal, and said common terminal.

34. The vehicle of claim 33, wherein:

(a) said door-safety-logic system comprises a close-stop switch With an input terminal that is connected to said door-close terminal of said safety-system control-signal input connector;

(b) said close-stop switch has a door-close output terminal that is connected to said door-close terminal of said safety-system control-signal output connector;

(c) said close-stop switch and said door-safety-logic system are constructed and interacted with one another in such a manner that, subsequent to initiation of operation of said door-safety-logic system, unless and until said pressure-activated switch changes operational state as a result of one of said at least one fluid-chamber contact-sensing door-edge attachments contacting an obstruction and communicating a "contact-sensed" signal thereto, said close-stop switch has an operational state in which its input terminal and its door-close output terminal are connected to one another such that a door-close control signal can be communicated between said door-close terminal of said safety-system control-signal input connector and said door-close terminal of said safety-system control-signal output connector through said close-stop switch; and (d) said close-stop switch and said door-safety-logic system are constructed and engaged to one another in such a manner that, subsequent to initiation of operation of said door-safety-logic system, when said pressure-activated switch changes operational state as a result of one of said at least one fluid-chamber contact-sensing door-edge attachments contacting an obstruction and communicating a "contact sensed" signal thereto, said close-stop switch assumes an operational state in which its input terminal and its door-close output terminal are disconnected from one another such that a door-close control signal cannot be communicated between said door-close terminal of said safety-system control-signal input connector and said door-close terminal of said safety-system control-signal output connector through said close-stop switch.

35. The vehicle of claim 34, wherein:

(a) said close-stop switch is a relay that connects its input terminal to its door-close output terminal when its energizing coil is not energized and which disconnects its input terminal from its output terminal when its energizing coil is energized; and (b) said energizing coil of said close-stop switch is connected with circuitry of said door-safety-logic system in such a manner that, when a door-close signal is transmitted to said door-close terminal of said safety-system control-signal input connector and either of said first contact-sensing door-edge attachment and said second contact-sensing door-edge attachment contacts an obstruction, communicates a "contact-sensed" signal to said pressure-activated switch, and causes said pressure-activated switch to change operational state said energizing coil of said door-close switch is energized.

36. The vehicle of claim 35, wherein:

(a) said close-stop switch has a door-open output terminal that is connected to said door-open terminal of said safety-system control-signal output connector; and (b) said close-stop switch is of a construction such that, when its energizing coil is energized, its input terminal and its door-close output terminal are connected to one another.

37. The vehicle of claim 36, wherein:

(a) said energizing coil of said close-stop switch is connected in series with said pressure-activated switch between said door-close terminal of said safety-system control-signal input connector and said common terminal of said safety-system control-signal input connector.

38. A vehicle, comprising:

(a) one or more frame structures that to which a majority of other components of said vehicle are engaged directly or indirectly and from which a majority of other components of said vehicle derive support directly or indirectly;

(b) a suspension system to which said one or more frame structures of said vehicle are engaged and from which said one or more frame structures derive support above said ground;

(c) one or more body structures that are mounted to said one or more frame structures;

(d) wherein one or more of said body structures comprises an entrance-door frame structure that surrounds an entrance-door opening;

(e) wherein one or more door panels are mounted to said body structure adjacent said entrance-door frame structure in such a manner that said one or more door panels are moveable through some combination of pivoting and/or translating between closed positions in which said door panels extend across and obstruct passage through said entrance-door opening and an open position in which said door panels leave said entrance-door opening unobstructed allowing passage of objects and/or individuals through said entrance-door opening;

(f) wherein one of said door panels comprises a first door edge that is disposed upon an opposite side of an entrance-door interface and an interface-bisection plane thereof from a second door edge when said door panel is disposed in its closed position;

(g) a powered actuator that is connected directly or indirectly to said door panel and also to actuator-mounting structure of said vehicle in such a manner that, when said powered actuator is commanded to do so it can actuate said door panel between said closed position and said open position thereof;

(h) an entrance-door control-system that is communicatively linked to said powered actuator in such a manner that said entrance-door control-system can be operated by an operator of said vehicle to command said powered actuator to actuate said door panel between said closed position and said open position thereof;

(i) an entrance-door safety-system;

(g) wherein said entrance-door safety-system comprises a first contact-sensing door-edge attachment that is mounted to said first door edge that said door panel comprises;

(h) wherein said entrance-door safety-system comprises a door-safety-logic system that is communicatively linked to said first contact-sensing door-edge attachment, said entrance-door control-system of said vehicle, and said powered actuator of said vehicle and that is constructed in such a manner that, when said powered actuator is actuating said door panel toward its closed position, if said first contact-sensing door-edge attachment meets an obstruction and communicates a "contact sensed" signal to said door-safety-logic system, said door-safety-logic system causes said powered actuator to cease actuation of said door panel toward its closed position;

(i) wherein said door-safety-logic system comprises a safety-system control-signal input connector that comprises a connector body with multiple connection terminals mounted to and fixed in an array by said connector body of said safety-system control-signal input connector;

(j) wherein said multiple connection terminals mounted to said connector body of said safety-system control-signal input connector include all connection terminals necessary to communicatively link said door-safety-logic system to said entrance-door control-system;

(k) wherein said door-safety-logic system comprises a safety-system control-signal output connector that comprises a connector body with multiple connection terminals mounted to and fixed in an array by said connector body of said safety-system control-signal output connector; and (j) wherein said multiple connection terminals mounted to said connector body of said safety-system control-signal output connector include all connection terminals necessary to communicatively link said door-safety-logic system to said powered actuator.

39. The vehicle of claim 38, wherein:

(a) said multiple connection terminals that are mounted to said connector body of said safety-system control-signal input connector comprise a door-open terminal, a door-close terminal, and a common terminal.

40. The vehicle of claim 39, wherein:

(a) said multiple connection terminals that are mounted to said connector body said of safety-system control-signal output connector comprise a door-open terminal, a door-close terminal, and a common terminal.

41. The vehicle of claim 40, wherein:

(a) said first contact-sensing door-edge attachment defines a first leading face at least three quarters of which through a transverse cross-section of said first contact-sensing door-edge attachment slopes in a same general direction at an angle of between 20 and 70 degrees relative to said interface-bisection plane of said entrance-door interface adjacent which said first door edge is disposed when said door panel is in its closed position.

42. The vehicle of claim 41, further comprising:

(a) a second contact-sensing door-edge attachment that is mounted to said second door edge of said vehicle;

(b) wherein said door-safety-logic system is further communicatively linked to said second contact-sensing door-edge attachment, said entrance-door control-system of said vehicle, and said powered actuator of said vehicle and is constructed in such a manner that, when said powered actuator is actuating said door panel toward its closed position, if said second contact-sensing door-edge attachment meets an obstruction and communicates a "contact-sensed" signal to said door-safety-logic system, said door-safety-logic system causes said powered actuator to cease actuation of said door-panel toward its closed position; and (c) wherein said second contact-sensing door-edge attachment defines a second leading face at least three quarters of which through transverse cross-sections of said second contact-sensing door-edge attachment slopes in a same general direction as does said first leading face and at an angle of between 20 and 70 degrees relative to said interface-bisection plane of said entrance-door interface adjacent which said second contact-sensing door-edge attachment is disposed.

* * * * *